US006821599B1

(12) United States Patent
Kuroda et al.

(10) Patent No.: US 6,821,599 B1
(45) Date of Patent: Nov. 23, 2004

(54) POROUS ACRYLIC FIBER AND FABRIC COMPRISING THE SAME, AND METHOD OF PRODUCING THE SAME

(75) Inventors: Minoru Kuroda, Hyogo (JP); Shoichi Murata, Hyogo (JP); Satoru Harada, Hyogo (JP)

(73) Assignee: Kaneka Corporation, Osaka (JP)

( * ) Notice: Subject to any disclaimer, the term of this patent is extended or adjusted under 35 U.S.C. 154(b) by 156 days.

(21) Appl. No.: 10/110,743

(22) PCT Filed: Oct. 12, 2000

(86) PCT No.: PCT/JP00/07063

§ 371 (c)(1),
(2), (4) Date: Apr. 12, 2002

(87) PCT Pub. No.: WO01/27364

PCT Pub. Date: Apr. 19, 2001

(30) Foreign Application Priority Data

Oct. 13, 1999 (JP) ..... H11-290771
Oct. 13, 1999 (JP) ..... H11-290772
Sep. 18, 2000 (JP) ..... H2000-281128

(51) Int. Cl.[7] ..... B32B 33/00; D02G 3/02; D02G 3/22; D02G 3/44; D01F 6/18

(52) U.S. Cl. ..... 428/97; 428/89; 428/397; 428/400; 264/178 R; 264/182; 264/204; 264/206

(58) Field of Search ..... 428/97, 89, 357, 428/364, 397, 398, 399, 400; 264/41, 178 R, 182, 187, 204, 206, 207

(56) References Cited

U.S. PATENT DOCUMENTS 4,438,060 A 3/1984 Reinehr et al.
4,442,173 A * 4/1984 Takegami et al. ..... 428/372
4,515,859 A * 5/1985 De Maria et al. ..... 428/398
5,436,275 A * 7/1995 Kawasaki et al. ..... 521/142

FOREIGN PATENT DOCUMENTS

| | | | | |
|---|---|---|---|---|
| BR | 9903748 A | * | 4/2001 | ..... D01F/6/18 |
| GB | 1355701 A | * | 6/1974 | ..... C08F/19/00 |
| GB | 1472645 A | * | 5/1977 | ..... D01D/5/06 |
| GB | 1590367 A | * | 6/1981 | ..... D01F/1/10 |
| GB | 2 285 009 A | | 8/1995 | |
| JP | 48001221 A | * | 5/1971 | |
| JP | 48001322 A | * | 5/1971 | ..... D01F/5/10 |
| JP | 48033170 A | * | 5/1973 | ..... D04H/3/00 |
| JP | 57-51812 A | | 3/1982 | |
| JP | 57101011 A | * | 6/1982 | ..... D01F/6/54 |
| JP | 57-101013 A | | 6/1982 | |
| JP | 63165510 A | * | 7/1988 | ..... D01F/6/38 |

* cited by examiner

*Primary Examiner*—Cheryl A. Juska
(74) *Attorney, Agent, or Firm*—Brinks Hofer Gilson & Lione

(57) ABSTRACT

Porous acrylic fibers produced by a method comprising subjecting a spinning dope containing 0.3 to 20 parts by weight of poly(vinyl acetate) relative to 100 parts of an acrylic copolymer to a wet spinning to give fibers, crimping and cutting the fibers, subjecting the resultant fibers to a treatment by hot water at 90 to 100° C. for 30 to 120 minutes or by saturated steam at 90 to 130° C. for 10 to 90 minutes to thereby form porous fibers; and a pile fabric having pile portions which comprise the porous fibers in an amount of 3 wt % or more, and, in the pile fabric, respective single fibers are visible being separate and emphasized, and thus the pile fabric has an appearance being highly decorative and excellent in design characteristics.

14 Claims, 2 Drawing Sheets

(A)

(B)

POROUS ACRYLIC FIBER AND FABRIC COMPRISING THE SAME, AND METHOD OF PRODUCING THE SAME

RELATED APPLICATIONS

This application is a nationalization of PCT application PCT/JP00/07063 filed Oct. 12, 2000. This application claims priority from the PCT application and Japan Application Serial No. H11(1999)-290771 filed Oct. 13, 1999; Japan Application Serial No. H11(1999)-290772 filed Oct. 13, 1999; Japan Application Serial No. H11(2000)-281128 filed Sep. 18, 2000.

TECHNICAL FIELD

The present invention relates to an acrylic fiber used mainly in pile fabrics, a pile fabric comprising this acrylic fiber, and a method of producing this acrylic fiber, and more particularly relates to an acrylic fiber which is easily porosified by a porosification treatment operation following spinning, and which has an external appearance in which a feeling of the presence of individual fibers is emphasized, and a pile fabric which is manufactured using this fiber, and which has extremely superior external appearance characteristics in which a feeling of the presence of individual fibers constructing the pile part is visually emphasized.

BACKGROUD ART

Acrylic type synthetic fibers have a fur-like hand and luster, and are widely used in the knit field, as well as in the boa and high-pile fields. In recent years, furthermore, there has been an increased demand to make the external appearance and hand of piles resemble those of natural fur more closely by using such acrylic fibers. In natural furs, the standing-hair portion of the fur generally has an intrinsic two-layer structure consisting of long hairs known as "guard hairs", and short hairs known as "down hairs" which grow densely beneath the guard hairs. Pile fabrics are fabrics which mimic this natural fur structure "as is"; acrylic type synthetic fibers have already seen wide use in pile products as a result of the natural hand and luster of such fibers. Usually, acrylic fibers used in the field of such pile products are subjected to working such as the creation of a shading effect by kneading a metallic compound into the fibers in order to cause the luster to resemble that of natural fur. For example, in Japanese Patent Application Laid-Open No.S56-44163, Japanese Patent Application Laid-Open No.S56-44164 and the like, methods are proposed in which acrylic fibers that have a fur-like luster are obtained by adding metallic compounds and cellulose derivatives to copolymers consisting of acrylonitrile. Furthermore, in Japanese Patent Application Laid-Open No.H3-146705, it is indicated that a fur-like luster can be realized by subjecting acrylic type synthetic fibers following drying (in which a metallic compound is added during the spinning process) to rapid cooling and overdrawing so that the fibers have cracks that are perpendicular to the axial direction of the fibers. However, although fibers obtained by these techniques have a fur-like external appearance at first glance, the impression that the individual fibers are covered by other surrounding fibers cannot be eliminated in cases where individual fibers are formed into a standing-hair fabric. Furthermore, in Japanese Patent Application Laid-Open No.H9-31797, it is indicated that in a pile fabric obtained by constructing the fabric from fibers produced by adding a delustering agent at the rate of 1.5 wt % or less to dischargeable fibers having a fixed thickness, and fibers containing such a delustering agent at the rate of 0.7 wt % or less, fibers with different brightness values are present in aggregations, so that the fabric has a wood-like coloring showing a grain. However, most of these effects relate to the print coloring characteristics in the pile fabric, and are not effects in which a feeling of the presence of individual fibers is visually emphasized in cases where the fabric is formed into a standing-hair fabric.

Thus, in the past, there have been few reports of fibers showing an external appearance in which a feeling of the presence of the individual fibers is emphasized in a pile fabric. Such reports include a technique in which the vaporization of a low-boiling-point solvent is utilized to endow the fiber cross section with voids (as indicated in Japanese Patent Application Laid-Open No.S62-177255) as a technique relating to coloring properties utilizing the porous structure of fibers. However, since this technique uses a low-boiling-point solvent as a bubbling agent, the technique suffers from a problem in terms of manufacture: namely, it is difficult to recover the low-boiling-point solvent used to form voids in the fiber cross section.

Meanwhile, in regard to fibers in which acrylic type copolymers are combined with other polymers, a fiber obtained by utilizing a void stabilizing agent such as cellulose acetate to stabilize the voids in the manufacturing process of the fiber is introduced in (for example) Japanese Patent Application Laid-Open No.S54-101920, and a fiber obtained by mixing cellulose acetate with an acrylic polymer produced by copolymerizing monomers containing 3 wt % or more sulfonate groups is introduced in Japanese Patent Application Laid-Open No.H6-2213. However, both of these fibers aim at improving the hygroscopic properties, so that the application of the fibers differs from that of the present invention. Moreover, these fibers are used in fields that require a water-absorbing/perspiration-absorbing function, such as underwear, socks, sportswear, towels and the like; accordingly, the denier of the fibers is small, and it appears from the embodiments that the width in the direction of the major axis of the fiber cross section, i. e., the maximum width, is 60 $\mu$m or less. Furthermore, an acrylic fiber which has a rubber-form polymer such as a polyvinyl acetate in an acrylic copolymer is introduced in Japanese Patent Application Laid-Open No.S60-110913; however, this fiber aims at preventing fiber splitting, and does not aim at endowing a fabric with an external appearance that is superior in design quality, in which a feeling of the presence of individual fibers (of the type described above) is emphasized. Furthermore, this fiber does not have a porous structure. Moreover, in regard to fibers in which a modacrylic type polymer and a vinyl acetate type polymer are combined, a porous fiber obtained by utilizing phase-separated polymers such as a modacrylic type polymer and a vinyl acetate type polymer, and arranging the process so that a void structure formed in the spinning process is maintained after spinning, is introduced in Japanese Patent Application Laid-Open No.S57-58811; however, the object in this case is to improve the hygroscopicity by means of voids formed by phase separation. Furthermore, the addition of a vinyl acetate type polymer to an acrylonitrile type polymer is disclosed in Japanese Patent Application Laid-Open No.H10-110326; however, this technique relates to process stability with the aim of increasing the productivity of acrylic fibers, and does not aim at emphasizing a feeling of the presence of the fibers, i. e., at obtaining an external appearance in which the individual fibers are visually emphasized, as in the present invention.

Thus, in the past, there has been no technique of obtaining an external appearance in which the individual fibers are emphasized by porosification following spinning.

DISCLOSURE OF THE INVENTION

Accordingly, it is an object of the present invention to provide a pile fabric which is endowed with external appearance characteristics that are superior in terms of design quality, i. e., in which a feeling of the presence of the individual fibers forming the pile part is emphasized, by porosifying acrylic fibers and using these porous acrylic fibers to form the pile fabric. More specifically, it is an object of the present invention to provide a novel porous acrylic fiber which can give an external appearance that is superior in terms of design quality, in which a feeling of the presence of the individual fibers is visually emphasized in the standing-hair part of a pile fabric, and in which such a special feature of the external appearance can be caused to appear conspicuously by porosification of the fiber in after-working following spinning, and a method of producing this fiber.

As a result of diligent research conducted by the present inventors in order to achieve the abovementioned object, it appeared that it was necessary to form a structure in which visible light passing through the interiors of the fibers is to some extent scattered and reflected in order to obtain an external appearance in which a feeling of the presence of the individual fibers is emphasized in the fibers of the standing-hair portion of a pile fabric. Accordingly, the inventors further investigated a method in which components with different refractive indices are caused to be present in blocks, and the material forming the fibers is porosified; in addition, the inventors investigated the thickness that allows the fibers of the standing-hair portion to be visually recognized as individual fibers. Specifically, considering novel fibers which can be porosified by an after-process and which have an external appearance in which a feeling of the presence of the fibers is emphasized, the inventors focused on the cohesive force and incompatibility of the internal constituent components of the fibers in order to form fibers in which a porosified structure can easily be realized by the action of heat and water that can generally be used in an after-process even in the case of fibers that have a homogeneous structure on the macroscopic level, and investigated polymers that have a strong phase separation effect and that show good fiber moldability even when mixed. As a result, the inventors discovered a method whereby porosification can be accomplished utilizing the effects of heat and moisture of after-working by specifying the types of polymers added even in the case of fibers in which the voids have already been baked out by heating effected by drying, heat treatment or the like, although the relationship between the porous structure of the gel-form fibers obtained by the wet spinning of acrylic type copolymers and the re-porosified fiber structure obtained by after-working is unclear. This discovery led to the perfection of the present invention.

Specifically, the porous acrylic fiber of the present invention is a porous acrylic fiber which consists chiefly of a resin composition containing 0.3 to 20 parts by weight of polyvinyl acetate per 100 parts by weight of acrylic type copolymer, and in which the rate of the drop in the specific gravity as calculated by the following Equation (1) is in the range of 5.0 to 20%.

$$\text{Rate of drop in specific gravity (\%)}=100\times(1-Da/Db) \quad \text{(Equation 1)}$$

[In the above equation, Da indicates the specific gravity value of the porous acrylic fiber, and Db indicates the true specific gravity value resin consisting of the acrylic type copolymer.]

It is desirable that the abovementioned acrylic type copolymer be a copolymer consisting essentially of 35 to 98 wt % acrylonitrile and 2 to 65 wt % other monomer that is copolymerizable with acrylonitrile. Furthermore, it is even more desirable that the abovementioned acrylic type copolymer be a copolymer consisting essentially of 35 to 98 wt % acrylonitrile, 2 to 65 wt % vinyl chloride and/or vinylidene chloride, and 0 to 10 wt % sulfonate-group-containing monomer that is copolymerizable with these compounds.

Furthermore, in regard to the resin composition of the abovementioned porous acrylic fiber, this composition may contain 0.3 to 20 parts by weight polyvinyl acetate and 0.5 to 15 parts by weight cellulose resin per 100 parts by weight of acrylic type copolymer. Cellulose acetate, cellulose propionate and cellulose acetate butyrate are desirable as the abovementioned cellulose resin.

In the abovementioned acrylic fiber, it is desirable that the major-axis width in the fiber cross section be 70 to 300 $\mu$m.

The method of the present invention for producing such a porous acrylic fiber is a method which is characterized in that a fiber formed by wet-spinning a spinning stock solution containing 0.3 to 20 parts by weight of polyvinyl acetate per 100 parts by weight of acrylic type copolymer, or a fiber formed by wet-spinning a spinning stock solution containing 0.3 to 20 parts by weight of polyvinyl acetate and 0.5 to 15 parts by weight cellulose resin per 100 parts by weight of acrylic type copolymer, is subjected to crimping and cutting treatments, and is then porosified by a hydrothermal treatment for 30 to 120 minutes at 90 to 100° C. and/or a saturated steam treatment for 10 to 90 minutes at 90 to 130° C. The abovementioned hydrothermal treatment may also be a dyeing operation.

The porous acrylic fiber of the present invention is a porous acrylic fiber that is manufactured by the abovementioned production method, and is preferably a fiber in which the rate of the drop in the specific gravity calculated by the following Equation (2) from the specific gravity (Dp) prior to porosification and the specific gravity (Da) of the porosified fiber is in the range of 3.0 to 15%.

$$\text{Rate of drop in specific gravity (\%)}=100\times(1-Da/Dp) \quad \text{(Equation 2)}$$

The pile fabric of the present invention consists of the abovementioned porous polyacrylic fiber. In this pile fabric, it is desirable that the abovementioned porous acrylic fiber be contained in the pile part at the rate of 3 wt % or greater. Furthermore, it is desirable that this pile fabric be a pile fabric having a step difference that has at least a long-pile part and a short-pile part, and that the abovementioned porous acrylic fiber be contained in the long-pile part. Moreover, it is desirable that this pile fabric contain the abovementioned acrylic fiber at the rate of 5 to 60 wt % in the pile part as a whole. In the abovementioned pile fabric having a step difference, it is desirable that the difference between the mean pile length of the long-pile part and the mean pile length of the short-pile part be 2 mm or greater, and that the mean pile length of the long-pile part be 12 to 70 mm.

The present invention will be described in greater detail below.

The acrylic type copolymer that forms the acrylic fiber of the present invention contains acrylonitrile as the chief component of the copolymer, and is a copolymer with a vinyl type monomer that is copolymerizable with this acrylonitrile. The abovementioned acrylic type copolymer is preferably a copolymer that contains 35 to 98 wt % acrylonltrile and other vinyl type monomers that are copolymerizable with acrylonitrile. Even more preferably, the acrylonitrile content is 35 to 90 wt %. Examples of the abovementioned vinyl type monomers that are copolymerizable with acrylonitrile include vinyl halide and vinylidene halides as represented by vinyl chloride, vinylidene chloride, vinyl bromide, vinylidene bromide and the like, unsaturated carboxylic acids as represented by acrylic acid and methacrylic acid, and salts of these acids, acrylic acid esters and methacrylic acid esters as represented by methyl acrylate and methyl methacrylate, vinyl esters as represented by vinyl acetate and vinyl butyrate, vinyl type amides as represented by acrylamide and methacrylamide, sulfonate-group-containing monomers as represented by methallylsulfonic acid, styrenesulfonic acid and salts of these acids, and other compounds such as vinylpyridine. methylvinyl ether, methacrylonitrile and the like. The acrylic type copolymer may be an acrylic type copolymer obtained by copolymerizing one or more of these compounds. Moreover, styrenesulfonic acid, para-styrenesulfonic acid, allylsulfonic acid, methallylsulfonic acid, para-methacryloyloxybenzenesulfonic acid, methacryloyloxypropylsulfonic acid and metal salts or amine salts of these acids may be used as the abovementioned sulfonate-group-containing vinyl type monomers. In the present invention, a copolymer consisting essentially of 35 to 98 wt % acrylonitrile, 2 to 65 wt % vinyl chloride and/or vinylidene chloride and 0 to 10 wt % sulfonate-group-containing vinyl type monomer that is copolymerizable with these compounds is desirable. Of course, the present invention is not adversely affected even if the acrylic type copolymer constituting the main component that forms the acrylic fiber consists of a polymer with a different composition and copolymerization proportions. Examples of solvents that can be used for the wet spinning of such copolymers include organic solvents such as acetone, acetonitrile, dimethylformamide, dimethylacetamide, dimethyl sulfoxide and the like.

The polyvinyl acetate (hereafter abbreviated to "PVAc") used may be a commercially marketed PVAc, and may be dissolved beforehand in the solvent used in the spinning stock solution of the acrylic type copolymer, or may be directly dissolved in the spinning stock solution. Alternatively, this PVAc may be solution-polymerized by a universally known technique using the solvent that forms the spinning stock solution of the acrylic type copolymer, and this polymer solution may be used. If necessary, the PVAc may be partially or completely saponified, and the type of solvent used in the spinning stock solution may be appropriately selected in accordance with the solubility. For example, in cases where dimethyl sulfoxide is used as the solvent, use is possible even at a degree of saponification of 99.5% or greater; on the other hand, in cases where acetone is used as the solvent, the degree of saponification is 50% or less, preferably 40% or less. The reason for this is that in cases where the degree of saponification is 50% or greater, the solubility of PVAc in acetone drops, so that the filterability of the spinning stock solution drops, thus having a deleterious effect on the spinnability. The amount of PVAc that is added to the acrylic type copolymer is preferably in the range of 0.3 to 20 parts by weight per 100 parts by weight of the acrylic type copolymer, and is even more preferably in the range of 1 to 10 parts by weight per 100 parts by weight of the acrylic type copolymer. If the amount added is less than 0.3 parts by weight, the porosifying effect of the hydrothermal treatment and/or saturated steam treatment performed following spinning is insufficient, so that porosified fibers with the desired external appearance cannot be obtained. Specifically, an increase in the brightness, which is one of the three elements of the color that appears when the fibers are colored to a desired hue, cannot be obtained, so that an external appearance in which a feeling of the presence of the individual fibers is emphasized cannot be achieved. On the other hand, if the amount of PVAc that is added exceeds 20 parts by weight, the state of phase separation between the acrylic type copolymer and the PVAc is increased, so that the spinning stability and coagulation in the fiber forming process deteriorate, thus making continuous production difficult. Accordingly, such a large amount is undesirable.

In regard to the cellulose resin, cellulose acetate, cellulose propionate or cellulose acetate butyrate may be used; as in the case of the PVAc, the resin used may be appropriately selected In accordance with the type and solubility of the solvent used in the spinning stock solution. In cases where acetone is used as a solvent, it is desirable that the degree of acetification of cellulose acetate be 52 to 59%. The amount added is preferably 0.5 to 15 parts by weight per 100 parts by weight of the acrylic type copolymer, and is even more preferably 1 to 10 parts by weight per 100 parts by weight of the acrylic type copolymer. If the amount added is less than 0.5 parts by weight, the phase separation effect caused by the cellulose resin drops. Furthermore, there is an accompanying drop in the synergistic effect caused by the addition of PVAc, so that the desired external appearance cannot be obtained. On the other hand, if the amount added exceeds 15 parts by weight, the spinning stability and drawability in the fiber forming process deteriorate, so that there is a drop in the continuous productivity or productivity per unit time. Accordingly, such a large amount is undesirable.

In regard to the adding and mixing of the PVAc and cellulose resin with the acrylic type copolymer, these ingredients can be directly mixed and agitated inside the spinning stock solution tank, with defoaming then being performed to form the spinning stock solution. Alternatively, a line mixer such as a dope grinder, static mixer or the like can be used in the process that immediately precedes the spinning nozzle in the spinning stock solution feeding line.

Various types of additives such as stabilizers and anti-oxidants for the purpose of preventing decomposition or coloring caused by heat and light, modifiers for the purpose of improving dyeing characteristics, anti-static agents, hygroscopicity-improving agents, coloring agents such as pigments, dyes and the like for coloring the fibers to the desired hue, various types of delustering agents, and polymers for the purpose of improving other fibers characteristics, may be added to the spinning stock solution for the purpose of improving the fiber performance, with these additives being varied according to various required fiber characteristics, and added in amounts that do not interfere with the object of the present invention. In particular, if additives that have the effect of making the fibers opaque are used in combination with the above components, the minor-axis width of the fiber cross section can be reduced with respect to the object of the present invention.

The polymer concentration of the spinning stock solution used in the present invention is generally adjusted to a value of 20 to 35 wt %, and is preferably adjusted to a value of 25 to 32 wt % if spinnability and process stability are taken into account. In cases where this concentration is less than 20 wt %, the amount of solvent extraction agent that is discharged from the nozzle is increased, so that it becomes difficult to obtain a uniform cross section. On the other hand, if the concentration exceeds 35 wt %, the viscosity increases so that the spinning stock solution tends to gel, and so that monofilament breakage during spinning becomes common.

The spinning stock solution prepared by mixing specified polymers as described above can be formed into a fiber by a universally known spinning method for acrylic fibers. It is desirable that the denier of the acrylic fiber in this case be 2 to 50 decitex (hereafter abbreviated to "dtex"). In particular, a denier in the range of 3 to 30 dtex makes it easier to obtain the abovementioned special features, and is therefore ideal. If the denier is less than 2 dtex, the fibers become too slender so that a feeling of the presence of individual short fibers cannot be obtained when the fibers are formed into a pile fabric. On the other hand, if the denier exceeds 50 dtex, the fibers become too thick, so that the resulting pile fabric tends to have a hard hand; accordingly, such a large denier is undesirable. Furthermore, there are no particular restrictions on the fiber cross section; however, a flat, elliptical, crescent-shaped or dog-bone-shaped cross section is desirable. In this case, in order to emphasize the visual effect, the width of the fiber cross section in the direction of the major axis, i. e., the maximum width, is preferably 70 $\mu$m or greater, more preferably 90 $\mu$m or greater, and even more preferably 110 $\mu$m or greater. The upper limit on this width is 300 $\mu$m. In cases where the maximum width exceeds this limit, the impression of a fiber-form film which imparts a disharmonious sensation in which planarity is emphasized to a far greater extent than the linear images of the individual fibers becomes strong, which is undesirable. If the maximum width is less than the lower width of 70 $\mu$m, there is a lack of any feeling of the presence of individual fibers. Furthermore, this width of the fiber cross section in the direction of the major axis (maximum width) refers to the maximum distance between two parallel lines circumscribing the fiber cross section. Meanwhile, in a case where the width of the fiber cross section contained by two lines parallel to the direction of width in the direction of the major axis, i. e., parallel to the direction of the maximum width, is taken as the minor axis, the width in the direction of this minor axis is preferably 8 $\mu$m or greater, and is even more preferably 10 $\mu$m or greater. In cases where this width is less than 8 $\mu$m, a transparent image is emphasized when the fibers are viewed from a direction perpendicular to the direction of the major axis of the fiber cross section, so that a feeling of the presence of individual fibers is lacking. Here, the term "flattened} does not necessarily indicate a strict rectangular shape; as long as the flattening ratio (ratio of the major-axis width to the minor-axis width) is 2.5 or greater in a case where the maximum width of the fiber cross section is taken as the major axis, and the width of the fiber cross section contained by two lines parallel to the major axis is dad taken as the minor axis, the cross-sectional shape is not particularly restricted, and may be elliptical or crescent-shape, and may also include indentations and projections as in a group of spikes or pot lid. On the other hand, if the flattening rate exceeds 25, a transparent image is emphasized when the fibers are viewed from a direction perpendicular to the major-axis direction, and the fiber cross section tends to split: accordingly, such a flattening rate is undesirable.

Necessary treatments and operations such as the application of an oiling agent, mechanical crimping, cutting and the like are performed on the fiber obtained as described above. In this case, the term "mechanical crimping" refers to crimping obtained by a universally known method such as a gear crimping process, stuffing box process or the like. There are no particular restrictions on this crimping; however, a desirable crimped shape is a shape with a crimping degree of 4 to 15%, preferably 5 to 10%, and with 6 to 15 peaks/inch, preferably 8 to 13 peaks/inch, as the number of crimping peaks. The abovementioned crimping degree is obtained by a measurement method of the type represented by the method described in JIS-L1074. Afterward, these fibers are cut. There are no particular restrictions on the fiber length of the cut fibers; however, in the case of use in a pile fabric, it is desirable to cut the fibers to an appropriately selected length in the range of 20 to 180 mm.

When the fibers are subjected to a hydrothermal treatment and/or saturated steam treatment after being subjected to crimping and cutting treatments as described above, with these fibers preferably being exposed to a moist atmosphere at a temperature of approximately 100° C. to 120° C., voids are generated in the interior portions of the fibers so that the fibers become porous. The term "porous" as used in the porous acrylic fiber of the present invention preferably refers to a configuration in which (for example) numerous voids with a diameter of several tens of nanometers extending In the direction of length of the fibers are present as shown in FIG. 1. The hydrothermal treatment and/or saturated steam treatment that are used in order to porosify the acrylic fiber as described above differ from the universally known pressurized steam treatment performed for the purpose of heat treatment relaxation in the manufacturing process of acrylic fibers in that such a hydrothermal treatment and/or saturated steam treatment are performed for the purpose of fiber porosification. These treatments are performed on fibers that have at least been dried and subjected to treatments such as drawing or the like, and are performed on the fibers in an after-treatment process following crimping and cutting treatments. The reason that the fibers are porosified by this hydrothermal treatment and/or saturated steam treatment is apparently that the dense structure formed by the drawing, drying, heat treatment or steam relaxation treatment in the fiber manufacturing process is converted into a stable structure as a result of the plasticization of the acrylic type copolymer caused by the effects of excess moisture such as wet steam, hot water or the like in the hydrothermal treatment of saturated steam treatment, with voids being generated at the boundary surfaces with the PVAc and cellulose resin, which have poor compatibility with the acrylic type copolymer. Furthermore, the reasons for the synergistic effect of PVAc and the cellulose resin are unclear; however, it appears that increased density or the generation of voids is at first prevented in the fiber manufacturing process by the adhesion and hydrophilicizing effect of PVAc, and that phase separation of the three components forming the fibers is further promoted by the effect of drawing moisture into the interior portions of the fibers in the subsequent moist atmosphere.

In regard to the treatment conditions of the abovementioned hydrothermal treatment, the treatment temperature is 90 to 100° C., preferably 95 to 100° C. In cases where the treatment temperature is lower than 90° C., a sufficient drop in the specific gravity of the fiber is not observed regardless of the treatment time, so that the porosification of the fiber is insufficient. The treatment time of the hydrothermal treatment in this case is 30 to 120 minutes, preferably 60 to 90 minutes. The reasons for this are as follows: specifically, in cases where the treatment time is less than 30 minutes, a sufficient drop in the specific gravity of the fiber does not occur, so that the desired porosified fiber cannot be obtained. On the other hand, in cases where the treatment time exceeds 120 minutes, yellowing of the fibers occurs. Furthermore, in regard to the treatment conditions of the saturate steam treatment, the treatment temperature is 90 to 130° C., preferably 98 to 110° C. The reasons for this are as follows: specifically, in cases where the treatment temperature is lower than 90° C., no drop in the specific gravity of the fiber is observed regardless of the treatment time, so that the porosification of the fiber is insufficient, as in the case of the hydrothermal treatment. On the other hand, in cases where the treatment temperature exceeds 130° C., the problem of yellowing of the fibers occurs. The steam treatment time in this case is 5 to 90 minutes, preferably 10 to 60 minutes. The reasons for this are as follows: specifically, in cases where the treatment time is less than 5 minutes, a sufficient drop in the specific gravity of the fiber does not occur, so that the desired porosified fiber cannot be obtained. On the other hand, in cases where the treatment time exceeds 90 minutes, yellowing of the fibers occurs.

The term "hydrothermal treatment" as used in the present invention refers to a treatment in which the fibers are immersed in hot water at a specified temperature, as performed using a universally known Obermeyer machine. In the p resent invention, the desired porosification is accomplished even if a dyeing operation is performed as this treatment; accordingly, the present invention also has the merit of not requiring the provision of an additional process for the purpose of porosification. The porous fibers that are colored to a desired hue by such a combination porosification treatment and dyeing operation generally have a high brightness (L value) caused by coloring compared to colored fibers that do not possess porosity, and show a special type of color. This visual special feature becomes conspicuous when the maximum width of the fiber cross section exceeds 70 $\mu$m as described above, so that the object of the present invention is sufficiently achieved.

Furthermore, as a concrete example of the saturated steam treatment performed in the present invention, the fibers are packed into a stainless steel basket, and this basket is set in a pressurize steamer, so that the fibers are treated at a specified temperature.

The degree of porosification of the abovementloned acrylic fibers can be adjusted to some extent by adjusting the respective contents of the PVAc and cellulose resin present in the fibers, and by adjusting the temperature and time of the porosification treatment. Furthermore, in order to make the visual effect obtained by porosification more conspicuous, it is desirable to set the rate of the drop in the specific gravity of the porous acrylic fiber with respect to the true specific gravity of the resin consisting of the acrylic type copolymer in the range of 5.0% to 20% and more preferably in the range of 7.0% to 15%, and to set the rate of the drop in the specific gravity before and after the hydrothermal treatment or saturated steam treatment as described above, in the range of 3.0% to 15%, and more preferably in the range of 3.0% to 10%. Specifically, the degree of porosification can be determined not only from the external appearance, but also from the change in the specific gravity of the fibers. Furthermore, the rate of the drop in the specific gravity value (Da) of the porous acrylic fiber of the present invention relative to the true specific gravity value (Db) of the resin consisting of the acrylic type copolymer is in the range of 3.0% to 15%, and is preferably in the range of 3.0% to 10%. By forming a pile fabric using fibers that have thus been porosified, it is possible to manufacture a pile fabric that has an external appearance with superior design quality, in which a feeling of the presence of the individual fibers that form the pile fabric is emphasized. In cases where the rate of the drop of the specific gravity (Da) of the porous acrylic fiber from the true specific gravity (Db) based in the acrylic type copolymer is less, than 5.0%, or the rate of the abovementioned drop in the specific gravity before and after porosification is less than 3.0%, the fibers are insufficient as porous fibers, so that a feeling of the presence of individual short fibers is not visually emphasized in the pile fabric, and special external appearance characteristics cannot be obtained. On the other hand, in cases where the rate of the drop in the specific gravity (da) of the porous acrylic fiber with respect to the true specific gravity (Db) based on the acrylic type copolymer exceeds 20%, or in cases where the rate of the drop in the specific gravity before and after porosification exceeds 15%, there is a deleterious effect on the mechanical properties of the fibers.

Here, the abovementioned "true specific gravity value (Db) of the resin consisting of the acrylic type copolymer" is the specific gravity determined by the substitution-in-water method for the acrylic type copolymer resin compression-molded using a tablet agent molding device or the like prior to the dissolution of the resin in the solvent. The rate of the drop in the specific gravity of the porous acrylic fiber relative to the true specific gravity value (db) of the resin consisting of the acrylic type copolymer is calculated using the following Equation (1) from the specific gravity value (Da) of the porous acrylic fiber and the abovementioned true specific gravity value (Db) of the resin consisting of the acrylic type copolymer.

$$\text{Rate of drop in specific gravity (\%)}=100\times(1-Da/Db) \quad \text{(Equation 1)}$$

Furthermore, the abovementioned rate of the drop in the specific gravity before and after porosification is calculated using the following Equation (2) from the specific gravity (Dp) of the fiber prior to porosification and the specific gravity (Da) of the fiber porosified by the hydrothermal treatment and/or saturated steam treatment. Furthermore, the abovementioned specific gravity of the fiber is measured according to the substitution-in-water method of JIS K7112.

$$\text{Rate of drop in specific gravity (\%)}=100\times(1-Da/Db) \quad \text{(Equation 2)}$$

Furthermore, the pile fabric of the present invention is manufactured using the porous acrylic fiber obtained as described above, and is a pile fabric in which the abovementioned porous acrylic fiber is contained in the pile part at the rate of 3 wt % or greater, preferably 10 to 70 wt %. In cases where the proportion of the porous acrylic fiber in the pile part is less than 3 wt %, the color difference from other fibers is insufficient, so that superior external appearance characteristics in which a feeling of the presence of individual fibers is emphasized cannot be obtained.

The term "pile part" used in the present invention refers to the standing-hair part of the pile fabric (standing-hair fabric) excluding the portion that consists of the base fabric (base yarn portion). Furthermore, the term "pile lengths" refers to the length from the roots of the abovementioned standing-hair part to the tip ends of the standing-hair part. Furthermore, the term "mean pile lengths" refers to the mean value obtained when the length from the roots of the fibers forming the pile part (i. e., the roots of the pile fabric surface) to the long pile parts is measured in ten places with the fibers forming the pile part in the pile fabric caused to stand up in a vertical attitude so that the fibers are lined up in a uniform manner.

In general, pile fabrics consist of various types of fabrics, including fabrics with a fixed pile length and fabrics in which long and short pile parts are mixed. In the pile fabric of the present invention, there are no particular restrictions on the abovementioned pile length; however, it is more effective if the pile fabric is a pile fabric that has a step, i. e., a two-stage pile with a long pile part and a short pile part, or a three-stage pile with a long pile part, an intermediate pile part and a short pile part. For example, in a three-stage pile of the type shown in FIG. 2, the abovementioned "long pile part" refers to the so-called guard hair part in which the pile length is the longest (part a), the "intermediate pile part" refers to the so-called middle hair part in which the pile length is next longest (part b) after that of the long pile part, and the "short pile part" refers to the so-called down hair in which the pile length is shortest (part c). The "step difference" in the present invention is expressed as the difference between part a and part c in the case of a two-stage pile, and as the difference between part a and part b in the case of a pile with three or more stages. Furthermore, such a step difference can be created using shrunken fibers or fibers that have different cut lengths.

Another preferable construction of the pile fabric of the present invention is a pile fabric which has a step difference of the abovementloned type, and which contains porous acrylic fibers as the fibers that form the long pile part in the pile fabric, with the content of such porous acrylic fibers among the fibers that form the pile part being 5 to 60 wt %, and preferably 10 to 50 wt %. In cases where porous acrylic fibers are used only in the intermediate pile part and short pile part, the porous acrylic fibers of the present invention which have superior external appearance characteristics are covered by the other fibers used as guard hairs, so that superior external appearance characteristics tend not be obtained when the fibers are formed into a pile fabric. Furthermore, in cases where the proportion of porous acrylic fibers used as the fibers that form this long pile part is less than 5 wt % of the overall pile part, and large numbers of other fibers are used as guard hairs, the porous acrylic fibers are covered by these other fibers, so that a sufficient effect in terms of external appearance characteristics cannot be obtained. On the other hand, in cases where this proportion exceeds 60 wt %, the proportion of porous acrylic fibers in the pile fabric becomes excessively large, so that guard hairs predominate; as a result, the step effect tends to be insufficiently expressed.

The method of development used to obtain a pile fabric consisting of acrylic fibers with superior external appearance characteristics can be appropriately set according to commercial designs for pile fabrics; however, if the abovementioned acrylic fibers with a large flattening rate and thick denier are used in a pile fabric, a finish that is visually emphasized to a much greater extent can be obtained. In the case of a method of use in which the proportion of the abovementioned acrylic fibers in the guard hair part is small, these acrylic fibers stand out in a sparse manner, which is effective as a so-called visual effect, and the non-bundling of the fibers is further emphasized so that the fabric shows a more fur-like hand with a superior hair-loosening effect.

Furthermore, in regard to the respective proportions of the long pile part and short pile part in the overall pile, it is desirable to use a construction in which the ratio of the long pile part/short pile part=10~85 wt %/15~90 wt %. The step difference between the pile length of the fibers occupying the long pile part and the pile length of the fibers occupying the short pile part is 2 mm or greater, and is preferably 3 mm or greater. Furthermore, the pile length of the fibers occupying the long pile part is 12 to 70 mm, and is preferably 15 to 50 mm. In cases where the step difference is less than 2 mm, the boundary between the guard hairs and the down hairs tends to become indistinct; as a result, the effect of the present invention, which is made more distinct by such a step difference, becomes insufficient. Furthermore, in cases where the pile length of the long pile part is less than 12 mm, the abovementioned step effect cannot be sufficiently observed even if there is a significant step difference in the pile part. As a result, a conspicuous effect is not obtained. Conversely, if the pile length of the long pile part exceeds 70 mm, the abovementioned acrylic fibers in the pile fabric lack a feeling of body, so that the fabric is inadequate as a standing-hair product.

BEST MODE FOR CARRYING OUT THE INVENTION

Figure 1:
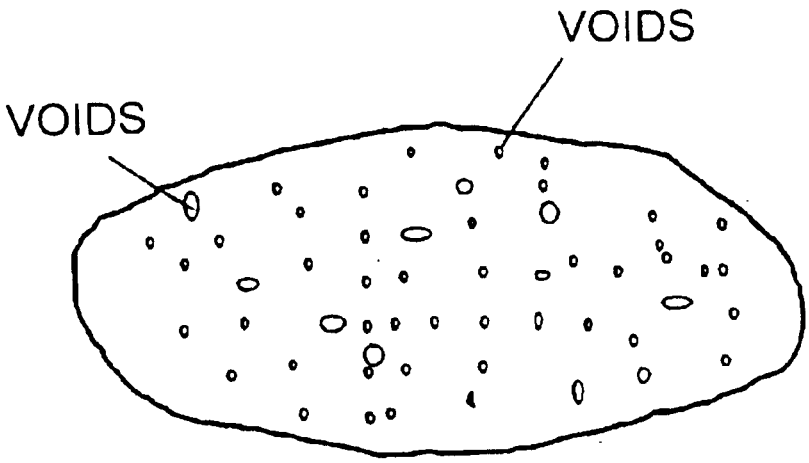
FIG. 1(A) is a model cross-sectional view of a porous acrylic fiber.
FIG. 1(B) is a model longitudinal-sectional view of the same.
Figure 1:
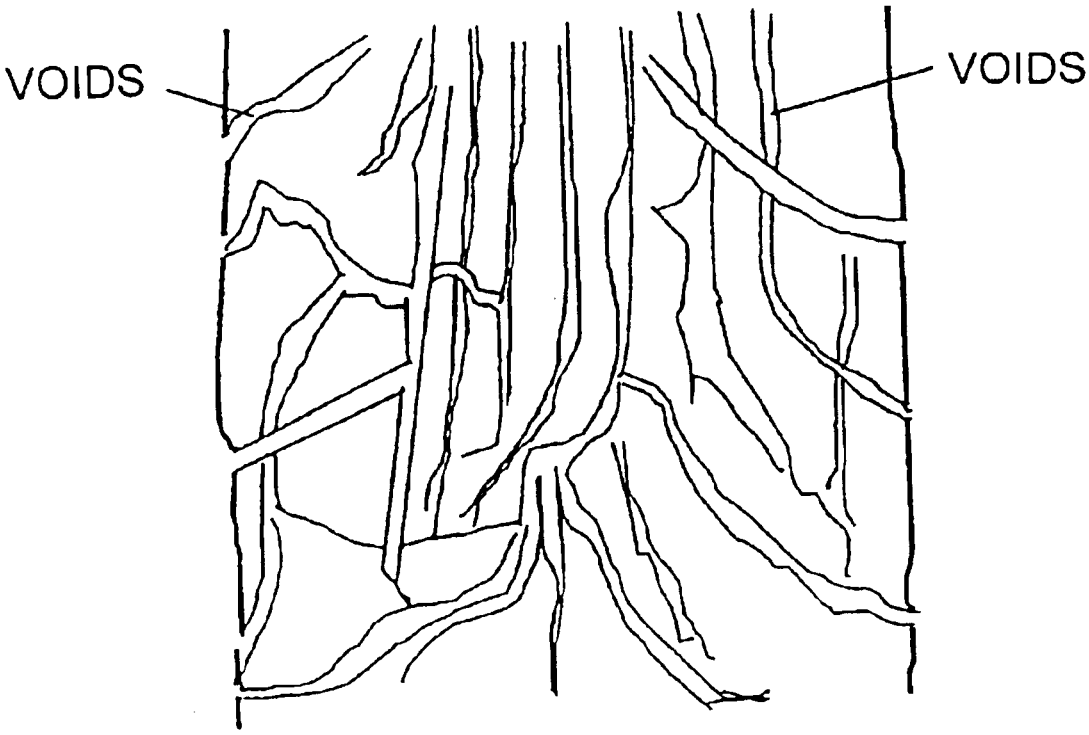
Figure 2:
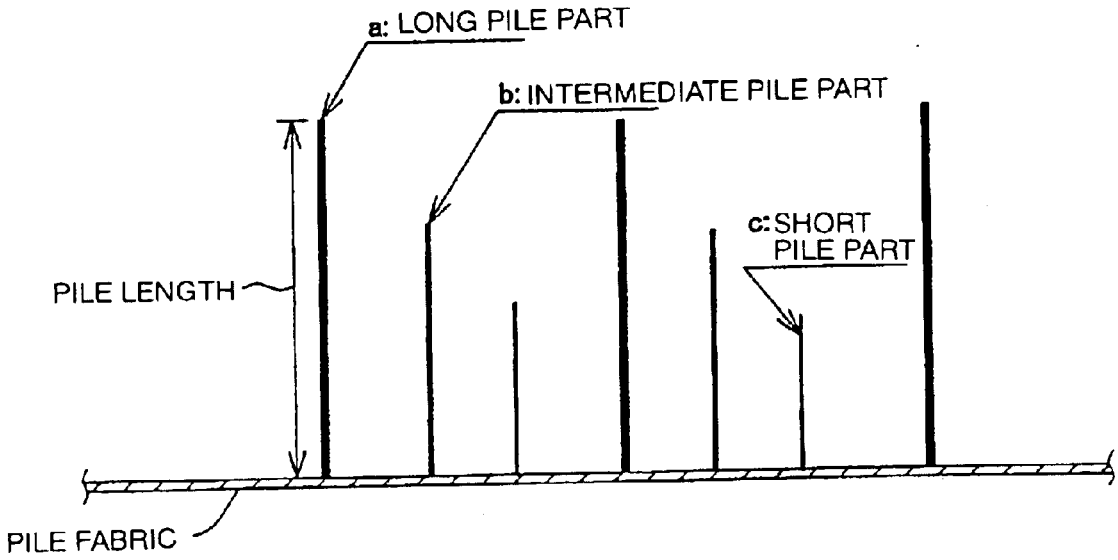
FIG. 2 is a model diagram of a pile fabric showing the step difference in a three-stage pile.

The present invention will be concretely described below in terms of examples; however, the present invention is not limited in any way by these examples.

Prior to the description of examples, the analysis and measurement conditions and evaluation methods used will be described.

(A) Denier

The denier was measured using an auto-vibro type denier measuring device "Denier Computer DC-11" (manufactured by Search Seigyo Denki); the mean value for a sample number n=25 was used.

(B) Fiber Cross-Sectional Length and Flattening Ratio

The fiber cross section on which Au had been vacuum-evaporated by means of an Ion Coater IB-3 (manufactured by Eiko Engineering) was observed using an S-3500N scanning electron microscope (manufactured by Hitachi Seisakusho) (scanning electron microscopic observation; hereafter referred to as "SEM observations"), and the major-axis width and minor-axis width were measured. Mean values for n=25 were used for the m major-axis width and minor-axis width. The flattening ratio (=major-axis width/minor-axis width) was determined from these major-axis width and minor-axis width values.

(C) Specific Gravity of Fibers

The specific gravity of the fibers was determined using an automatic specific gravity meter (high-precision model) D-H100 (manufactured by Toyo Seiki Seisakusho) in accordance with the substitution-in-water method of JIS K7112, with approximately 150 g of unraveled fabric being taken as a sample. Furthermore, the water used in the measurement of the specific gravity was prepared by adding a fluorine type surfactant to distilled water at the rate of 0.8 g/L. When the sample was immersed, the immersion rate was set at a rate slower that the rate of wetting caused by the capillary effect of the sample, and care was taken to insure that no bubbles were present between the fibers.

(D) Rate of Drop in Specific Gravity from True Specific Gravity of Fiber Consisting of Acrylic Type Copolymer Samples formed by compressing the acrylic type copolymer resin into solid tablets using a tablet molding device (pressure: 18 to 20 ton/cm$^2$) were measured in the same manner as described in (C) above in accordance with JIS K7112, thus determining the true specific gravity value (Db) of the resin consisting of the abovementioned acrylic type copolymer. Furthermore, in cases where the true specific gravity value of the resin consisting of the acrylic type copolymer is determined from the porous acrylic fibers, this can be measured by preparing samples in which the finely cut fibers (preferably cut fibers that will pass through a 200 mesh sieve) are molded into a solid tablet using a tablet molding device in the same manner as described above. However, if large amounts of additives other than the acrylic type copolymer are present, a slight error will be generated; accordingly, it is desirable to measure this value using only the acrylic type copolymer resin. In cases where additives are present, the true specific gravity value (Db) of the acrylic type copolymer can also be calculated with the theoretical specific gravity values of the additives being taken into account. For example, in a case where 0.3 to 20 parts by weight of PVAc is added to 100 parts by weight of the acrylic type copolymer, a converted value obtained by multiplying the specific gravity value determined from the fibers using the abovementioned method by 0.99 to 0.985 may be taken as the true specific gravity value of the acrylic type copolymer.

The rate of the drop in the specific gravity was calculated using the following Equation (1) from the true specific gravity value (Db) of the resin consisting of the abovementioned acrylic type copolymer determined as described above, and the specific gravity value (Da) of the porous acrylic fibers.

$$\text{Rate of drop in specific gravity (\%)}=100\times(1-Da/Db) \quad \text{(Equation 1)}$$

(E) Rate of Drop in Specific Gravity Before and After Porosification

This rate of drop was calculated using the following Equation (2) from the specific gravity (Dp) prior to porosification and the specific gravity (Da) of the fibers porosified by the hydrothermal treatment and/or saturated steam treatment.

$$\text{Rate of drop in specific gravity (\%)}=100\times(1-Da/Db) \quad \text{(Equation 2)}$$

F) Brightness: L Value

Fibers which had been unraveled and weighed out to a fixed weight were placed in a sample holder with a diameter of 30 mm, and the brightness was measured using a Type Σ 90 color difference meter (manufactured by Nippon Denshoku Kogyo) equipped with a light source conforming to the standard light source C described in JIS Z 8710. At the time of measurement, the dyed fabric sample was adjusted to a fabric sample density of 0.16 g/cm$^3$ and placed in the sample cell, and the L value was measured.

(G) Evaluation of External Appearance of Porous Acrylic Fibers

Fabric samples that were crimped, thoroughly unraveled and laminated were separated by approximately 50 cm, and the center portions of the laminated fabric samples were visually observed by 10 judges, and the feeling of a presence of individual short fibers was judged according to whether or not the single overlapping fibers could be individually distinguished. The judgement criteria were set as the following four grades:

◎: Individual fibers can be distinguished very easily even in an overall observation, so that the feeling of the presence of such fibers is strong.

○: Individual fibers can be distinguished easily even in an overall observation, so that a feeling of the presence of such fibers is recognized.

Δ: It is somewhat difficult to distinguish individual fibers in an overall observation, so that a feeling of the presence of such fibers is not recognized to any great extent.

X: Individual fibers can be distinguished by carefully directed visual observation, so that a feeling of the presence of such fibers can be recognized to a limited extent: in an overall observation, however, it is difficult to distinguish the individual fibers, so that a feeling of the presence of such fibers cannot be recognized.

(H) Evaluation of External Appearance Characteristics of Pile Fabric (i) Preparation of Pile Fabric Using the acrylic fibers obtained by the present invention, a pile fabric was knitted by means of a sliver knitting machine. Next, a pre-polishing treatment and a pre-shearing treatment were performed at 120° C. so that the pile length was made uniform. Afterward, the back surface of the pile was back-coated with an acrylic ester type adhesive agent. Subsequently, polishing was performed at 155° C., followed by brushing; then, polishing and shearing were performed in combination (two processes each) at 135° C., 120° C. and 90° C., and the crimp of the standing-hair surface layer was removed, thus producing a standing-hair fabric with a fixed pile length.

(ii) Evaluation of External Appearance

For the pile fabrics prepared by the method described in (i) above, the degree of external appearance characteristics in which a feeling of the presence of the individual short fibers forming the pile part was emphasized was evaluated by a sensual evaluation from the standpoints of visual and sensual perception using three evaluation grades, with this evaluation being performed according to the following criteria:

○: The product has external appearance characteristics in which a feeling of the presence of the individual short fibers in the pile fabric is emphasized to a considerable extent.

Δ: The abovementioned feeling of the presence of the individual short fibers in the pile fabric is inferior.

X: The abovementioned feeling of the presence of the individual short fibers in the pile fabric is markedly inferior.

(I) Mean Pile Length

The length from the roots of the fibers forming the pile part (the roots of the pile fabric surface) to end of the long pile part was measured in ten places using slide calipers after the fibers forming the pile part in the pile fabric were caused to stand in a vertical attitude so that the fibers were lined up in a uniform manner, and the mean values of the measurements thus obtained was taken as the mean pile length.

(J) Pile Step Difference

The "pile step difference" refers to the difference between the mean pile length of the long pile part and the mean pile length of the short pile part measured by the abovementioned method: this pile step difference was a calculated using the following equation:

Step difference (mm)=mean pile length (mm) of long pile part−mean pile length (mm) of short pile part.

EXAMPLES 1 and 2

A acrylic type copolymer consisting of 49 wt % acrylonitrile, 50 wt % vinyl chloride and 1 wt % sodium styrenesulfonate was dissolved in acetone, and 5 parts by weight of PVAc was further added per 100 parts by weight of the abovementioned acrylic type copolymer, thus producing a solution with a polymer concentration of 29 wt %. This solution was used as a spinning stock solution, and was wet-spun via a spinning nozzle with 3900 holes having a hole size of 0.08×0.6 mm into a solidifying bath consisting of an aqueous solution with a 30% concentration of acetone. Next, the spun fibers were passed through two baths consisting of aqueous solutions with respective acetone concentrations of 55% and 25%, and were drawn to a draw ratio of 2.0 times. Afterward, primary drawing was performed to a draw ratio of 3.0 times (in combination with the abovementioned drawing) in a water rinse bath at 75° C. Then, after an oiling agent was applied to the fibers thus obtained, the fibers were dried in an atmosphere at 110° C., and were further drawn at 125° C. so that the final draft was 6.5 times. Next, the fibers were heated in a dry-heat atmosphere at 145° C., thus producing fibers with a denier of 16.5 dtex. Next, appropriate oiling agent application and mechanical crimping were performed on these fibers using universally known methods, and the fibers were further cut to 51 mm. Afterward, the fibers were packed into an Obermeyer dyeing machine at a packing density of 0.30 g/cm$^3$, and were subjected to a hydrothermal treatment for 60 minutes at 98° C. (Example 1); alternatively, the fibers were packed into a stainless steel basket, and this basket was placed in a pressurized steamer, where a saturated steam treatment was performed for 20 minutes at 105° C. (Example 2). In this way, the desired fibers were produced.

EXAMPLE 3

An acrylic type copolymer consisting of 52 wt % acrylonitrile, 47 wt % vinylidene chloride and 1 wt % sodium styrenesulfonate and 10 parts by weight of PVAc was further added per 100 parts by weight of the abovementioned acrylic type copolymer, thus producing a solution with a polymer concentration of 29 wt %. This solution was used as a spinning stock solution, and was wet-spun via a spinning nozzle with 3900 holes having a hole size of 0.08×0.6 mm into a solidifying bath consisting of an aqueous solution with a 25% concentration of acetone. Next, the spun fibers were passed through two baths consisting of aqueous solutions with respective acetone concentrations of 30% and 15%, and were drawn to a draw ratio of 2.0 times. Afterward, primary drawing was performed to a draw ratio of 3.0 times (in combination with the abovementioned drawing) in a water rinse bath at 85° C. Then, after an oiling agent was applied to the fibers thus obtained, the fibers were dried in an atmosphere at 110° C., and were further drawn at 125° C. so that the final draft was 6.5 times. Next, the fibers were heated in a dry-heat atmosphere at 145° C., thus producing fibers with a denier of 16.5 dtex. Next, appropriate oiling agent application and mechanical crimping were performed on these fibers using universally known methods, and the fibers were further cut to 51 mm. Afterward, the fibers were packed into an Obermeyer dyeing machine at a packing density of 0.30 g/cm$^3$, and were subjected to a hydrothermal treatment for 60 minutes at 98° C., thus producing the desired fibers.

EXAMPLES 4 and 5

An acrylic type copolymer consisting of 93 wt % acrylonitrile and 7 wt % vinyl acetate was dissolved in dimethylacetamide (hereafter abbreviated to "DMAc"), and a spinning stock solution with a polymer concentration of 25 wt % was obtained by further adding 1 part by weight of PVAc to 100 parts by weight of the abovementioned acrylic type copolymer. This spinning stock solution was wet-spun via a spinning nozzle with 3900 holes having a hole size of 0.08×0.6 mm into a solidifying bath consisting of an aqueous solution with a 60% concentration of DMAc, and was further drawn to a draw ratio of 5.0 times while the solvent was washed away in boiling water. Next, an oiling agent was applied, and the fibers were dried by means of hot rollers at 150° C. Afterward, the fibers were subjected to a relaxation treatment in pressurized steam at a gauge pressure of 0.25 MPa, thus producing fibers with a denier of 16.5 dtex. Next, appropriate oiling agent application and mechanical crimping were performed on these fibers using universally known methods, and the fibers were further cut to 51 mm. Afterward, the fibers were packed into an Obermeyer dyeing machine at a packing density of 0.30 g/cm$^3$, and were subjected to a hydrothermal treatment for 60 minutes at 98° C. (Example 4); alternatively, the fibers were packed into a stainless steel basket, and this basket was placed in a pressurized steamer, where a saturated steam treatment was performed for 30 minutes at 105° C. (Example 5). In this way, the desired fibers were produced.

COMPARATIVE EXAMPLES 1 and 2

Fibers that had been manufactured as in Example 1 and cut to 51 mm were packed into an Obermeyer dyeing machine at a packing density of 0.30 g/cm$^3$, and a hydrothermal treatment was performed for 90 minutes at 80° C. (Comparative Example 1), or a hydrothermal treatment was performed for 10 minutes at 98° C. (Comparative Example 2), thus producing the desired fibers.

COMPARATIVE EXAMPLE 3

Fibers were manufactured by the same method as in Example 1 using a spinning stock solution in which no PVAc was added to the spinning stock solution used in Example 1. Next, appropriate oiling agent application and mechanical crimping were performed on these fibers using universally known methods, and the fibers were further cut to 51 mm. Afterward, the fibers were packed into an Obermeyer dyeing machine at a packing density of 0.30 g/cm$^3$, and were subjected to a hydrothermal treatment for 60 minutes at 98° C. thus producing the desired fibers. A pore distribution measurement was performed for the fibers thus obtained; however, no peaks indicating the presence of voids with diameters in the range of 1 nm to 100 nm were detected.

COMPARATIVE EXAMPLE 4

An acrylic type copolymer consisting of 93 wt % acrylonitrile and 7 wt % vinyl acetate was dissolved in DMAc, and a spinning stock solution with a polymer concentration of 25 wt % was obtained by further adding 3 parts by weight of PVAc to 100 parts by weight of the abovementioned acrylic type copolymer. This spinning stock solution was wet-spun via a spinning nozzle with 3900 holes having a hole size of 0.08×0.6 mm into a solidifying bath consisting of an aqueous solution with a 60% concentration of DMAc, and was further drawn to a draw ratio of 5.0 times while the solvent was washed away in boiling water. Next, an oiling agent was applied, and the fibers were dried by means of hot rollers at 150° C. Afterward, the fibers were subjected to a relaxation treatment in pressurized steam at a gauge pressure of 0.25 MPa, thus producing fibers with a denier of 16.5 dtex. Next, appropriate oiling agent application and mechanical crimping were performed on these fibers using universally known methods, and the fibers were further cut to 51 mm. Afterward, the fibers were packed into a stainless steel basket, and this basket was set in a pressurized steamer, where a saturated steam treatment was performed for 1 minute at 110° C., thus producing the desired fibers.

EXAMPLE 6

Fibers that had been manufactured as in Example 1 and cut 1 to 51 mm were packed into an Obermeyer dyeing machine at a packing density of 0.30 g/cm$^3$, and a dyeing treatment was performed, thus producing the desired fibers. The dyeing formula in this case was a dyeing formula prepared by mixing the dyes Maxilon Yellow 2RL 200% 0.132% omf, Maxilon Red GRL 150% 0.054% omf, and Maxilon Blue GRL 300% 0.018% omf (all manufactured by Ciba Specialty Chemical Inc.), and the dyeing assistants Levenol WX (manufactured by Kao Co.) 0.5% omf and Ultra MT #100 (manufactured by Mitejima Kagaku Co.) 0.5 g/L. Dyeing was performed with the temperature elevated from room temperature at the rate of 3° C./min, and maintained for 60 minutes at a constant temperature when a temperature of 98° C. was reached.

EXAMPLE 7

Fibers that had been manufactured as in Example 1 and cut to 51 mm were packed into an Obermeyer dyeing machine at a packing density of 0.30 g/cm$^3$, and a dyeing treatment was performed, thus producing the desired fibers. The dyeing formula in this case was a dyeing formula prepared by mixing the dyes The dyeing formula in this case was a dyeing formula prepared by mixing the dyes Maxilon Yellow 2RL 200% 0.0228% omf, Maxilon Red GRL 150% 0.0075% omf, and Maxilon Blue GRL 300% 0.0063% omf (all manufactured by Ciba Specialty Chemical Inc.), and the dyeing assistants Levenol WX (manufactured by Kao Co.) 0.5% omf and Ultra MT #100 (manufactured by Mitejima Kagaku Co.) 0.5 g/L. Dyeing was performed with the temperature elevated from room temperature at the rate of 3° C./min, and maintained for 60 minutes at a constant temperature when a temperature of 98° C. was reached.

Characteristic values and external appearance evaluation results for the fibers obtained in the abovementioned Examples 1 through 7 and Comparative Examples 1 through 4 are shown in Table 1.

Furthermore, the measurement of the L value for the fibers obtained in Examples 1 through 5 and Comparative Examples 1 through 4 was accomplished as follows:

specifically, the fibers obtained were dyed with the temperature elevated from room temperature at the rate of 3° C./min and maintained at a constant temperature for 60 minutes when a temperature of 98° C. was reached, using a dying formula prepared by mixing the dyes Maxilon Yellow 2RL 200% 0.127 omf, Maxilon Red GRL 0.113 omf, and. Maxilon Blue GRL 300% 0.118 omf (all manufactured by Ciba Specialty Chemical Inc.), and the dyeing assistants Levenol WX (manufactured by Kao Co.) 0.5% omf and Ultra MT #100 (manufactured by Mitejima Kagaku Co.) 0.5 g/L. After dyeing was completed, the dyeing solution was removed, and the dyed fabric material was dehydrated by centrifuging and dried at 80° C. The L value was measured for the dyed fabric material thus obtained using the method described in (F) above.

TABLE 1

| | Acrylic type copolymer composition | Solvent | Amount of polyvinyl acetate added (parts by weight) | Porosification treatment method | Treatment time (minutes) |
|---|---|---|---|---|---|
| Example 1 | AN/VCL | Acetone | 5 | 98° C. hot water | 60 |
| Example 2 | AN/VCL | Acetone | 5 | 105° C. pressurized steam | 20 |
| Example 3 | AN/VD | Acetone | 10 | 98° C. hot water | 60 |
| Example 4 | AN/VAc | DMAc | 1 | 98° C. hot water | 60 |
| Example 5 | AN/VAc | DMAc | 1 | 105° C. pressurized steam | 30 |
| Example 6 | AN/VCL | Acetone | 5 | 98° C. dyeing | 60 |
| Example 7 | AN/VCL | Acetone | 5 | 98° C. dyeing | 60 |
| Comparative Example 1 | AN/VCL | Acetone | 5 | 80° C. hot water | 90 |
| Comparative Example 2 | AN/VCL | Acetone | 5 | 98° C. hot water | 10 |
| Comparative Example 3 | AN/VCL | Acetone | 0 | 98° C. hot water | 60 |
| Comparative Example 4 | AN/VAc | DMAc | 3 | 110° C. pressurized steam | 1 |

| | Fiber cross-sectional length | | | True specific | Specific | Rate of drop in specific | Rate of drop in specific | | External |
|---|---|---|---|---|---|---|---|---|---|
| | Major-axis length (μm) | Minor-axis length (μm) | Flattening ratio | gravity of acrylic type copolymer (g/cm$^3$) | gravity of porosified fibers (g/cm$^3$) | gravity from true specific gravity (%) | gravity caused by porosification (%) | L value | appearance of porous acrylic fibers |
| Example 1 | 115 | 18 | 6.4 | 1.28 | 1.15 | 10.0 | 8.0 | 53.0 | ⊙ |
| Example 2 | 115 | 18 | 6.4 | 1.28 | 1.16 | 9.4 | 7.2 | 53.0 | ⊙ |
| Example 3 | 118 | 19 | 6.2 | 1.35 | 1.12 | 17.0 | 8.2 | 49.8 | ⊙ |
| Example 4 | 120 | 17 | 7.1 | 1.17 | 1.08 | 7.7 | 7.8 | 48.8 | ⊙ |
| Example 5 | 120 | 18 | 6.7 | 1.17 | 1.07 | 8.5 | 8.5 | 48.8 | ⊙ |
| Example 6 | 115 | 18 | 6.4 | 1.28 | 1.15 | 10.0 | 8.0 | 53.0 | ⊙ |
| Example 7 | 115 | 18 | 6.4 | 1.28 | 1.15 | 10.0 | 8.0 | 53.0 | ⊙ |
| Comparative Example 1 | 113 | 18 | 6.3 | 1.28 | 1.27 | 0.8 | 0.1 | 33.8 | X |
| Comparative Example 2 | 113 | 19 | 5.9 | 1.28 | 1.25 | 2.3 | 2.3 | 40.1 | X |
| Comparative Example 3 | 123 | 18 | 6.8 | 1.28 | 1.28 | 0 | 0 | 32.4 | X |
| Comparative Example 4 | 117 | 17 | 6.9 | 1.17 | 1.14 | 2.6 | 1.7 | 36.8 | X |

Note)
In the polymer compositions shown in the table, AN indicates acrylonitrile, VCL indicates vinyl chloride, VD indicates vinylidene chloride, and VAc indicates vinyl acetate.

Furthermore, the pore distribution of the dyed fabric material obtained in Example 1 was measured. The pore volume, porosity and the like obtained as a result of this measurement are shown in Table 2.

TABLE 2

| Pore volume Vp; CC · CC$^{-1}$ | Mean diameter D; nm | Porosity P; % | Sample volume (weight) V; cc (W; g) |
|---|---|---|---|
| 0.061 | 24 | 6.4 | 0.179 (0.1872) |

In Table 2, Vp indicates the cumulative volume of mercury injected at the measurement pressure, and P indicates the porosity;here, P=(Vp×W)/V [W:sample weight, V:sample volume].

Measurements were performed by the mercury pressure injection method using a Porosimeter—Pore Sizer 9320 manufactured by Micrometrics Co. Approximately 0.2 g of each sample was weighed out using an electronic balance (AEL200) manufactured by Shimazu Seisakusho;this sample was placed in the measurement cell, and mercury was injected under reduced pressure. The cell was then mounted in the apparatus and subjected to measurement. The measurement conditions are shown below.

Measurement pressure range: approximately 3.7 kPa to 207 MPa (pore diameter; approximately 70 angstroms to 400 μm)

Measurement mode; pressure elevation process in the abovementioned pressure range (1st run)

Cell volume: 5 $cm^3$

Number of measurements: 2

EXAMPLE 8

An acrylic type copolymer consisting of 49 wt % acrylonitrile, 50 wt % vinyl chloride and 1 wt % sodium styrenesulfonate was dissolved in acetone at the rate of 30 wt %. An acetone solution in which PVAc was dissolved at a concentration of 40 wt % was added to the abovementioned acetone solution so that the PVAc content of the resulting solution was 5 parts by weight per 100 parts by weight of the abovementioned acrylic type copolymer; furthermore, an acetone solution in which cellulose acetate with a degree of acetification of 55% was dissolved at the rate of 15 wt % was added to the abovementioned solution so that the cellulose acetate content of the resulting solution was 2.0 parts by weight per 100 parts by weight of the abovementioned acrylic type copolymer, and the solution obtained by mixing and agitating these ingredients was used as a spinning stock solution. This spinning stock solution was discharged into a solidifying bath consisting of a 25 wt % aqueous solution of acetone at 35° C. via a spinning nozzle with 400 rectangular slit-form holes having dimensions of 0.08 mm×0.6 mm, and the spun fibers were taken up by a roller at a take-up rate of 2 m/min. Next, drawing to a draw ratio of 1.4 times was applied in a 55 wt % aqueous solution of acetone at 25° C., and drawing to a draw ratio of 1.36 times was further applied in a 25 wt % aqueous solution of acetone at 25° C. Afterward, the fibers were rinsed with water via a water rinse bath at 40° C. and a water rinse bath at 75° C., and the fibers were then rinsed again while being drawn to a draw ratio of 1.5 times in a water rinse bath at 75° C. The fibers were then oiled. Next, after being dried in a uniform-heat air draft drier at 130° C., the fibers were further drawn to a draw ratio of 2 at the same temperature, and were then subjected to a heat treatment at 145° C. The fibers thus obtained had a denier of 17.5 dtex and fiber specific gravity of 1.28; furthermore, according to SEM observation, the major-axis width of the fiber cross section was 111 μm. Appropriate oiling agent application and pi mechanical crimping were performed on these fibers using universally known methods, and the fibers were further cut to 51 mm; afterward, the fibers were dyed with the temperature elevated from room temperature at the rate of 3° C./min and maintained at a constant temperature for 60 minutes when a temperature of 98° C. was reached, using a dying formula prepared by mixing the dyes Maxilon Yellow 2RL 200% 0.127 omf. Maxilon Red GRL 0.113 omf, and Maxilon Blue GRL 300% 0.118 omf (all manufactured by Ciba Specialty Chemical Inc.), and the dyeing assistants Levenol WX (manufactured by Kao Co.) 0.5% omf and Ultra MT #100 (manufactured by Mitejima Kagaku Co.) 0.5 g/L. After dyeing was completed, the dyeing solution was removed, and the dyed fabric material was dehydrated by centrifuging and dried at 80° C. In regard to the external appearance of the fibers following dyeing, the fibers appeared thicker than those of the fabric material prepared in Comparative Examples 5 through 7 described below. Furthermore, the dyed fabric material consisting of these fibers was a dyed fabric material with a superior external appearance, in which the L value was 49.8 and the rate of the drop in specific gravity caused by dyeing was 6.2%; moreover, SEM observation showed this fabric material to have a more or less rectangular cross section in which the major-axis width of the fiber cross section was 113 μm and the minor-axis width was 18 μm (flattening ratio: 6.3), and the feeling of the presence of individual fibers was conspicuous.

COMPARATIVE EXAMPLE 5

Fibers were manufactured in exactly the same manner as in Example 8, except that the respective acetone solutions of PVAc and cellulose acetate that were added to the spinning stock solution in Example 8 were not added. The fibers thus obtained had a denier of 18.2 dtex and a fiber specific gravity of 1.29; furthermore, it was found from SEM observation that the major-axis width of the fiber cross section was 115 μm. Appropriate oiling agent application and mechanical crimping were performed on these fibers using universally known methods, and the fibers were further cut to 51 mm; afterward, the fibers were dyed in the same manner as in Example 8. When the characteristics of the dyed fabric material were measured, it was found that the L value was 38.3 and the drop in specific gravity caused by dyeing was 0.5%. SEM observation indicated that the fibers had a more or less rectangular cross section in which the major-axis width of the fiber cross section was 116 μm and the minor-axis width was 18 μm (flattening ratio: 6.4): however, almost no porosification was observed.

COMPARATIVE EXAMPLE 6

Fibers were manufactured in exactly the same manner as in Comparative Example 5, except that the shape of the slits in the spinning nozzle used in Comparative Example 5 was changed to a round shape with a hole diameter of 0.22 mm. As a result, fibers with a denier of 17.2 dtex were obtained. Appropriate oiling agent application and mechanical crimping were performed on these fibers using universally known methods, and the fibers were further cut to 51 mm; afterward, the fibers were dyed in the same manner as in Example 8. When the characteristics of the dyed fabric material were measured, it was found that the L value was 33.7 and the drop in specific gravity caused by dyeing was 0%; no porosification was observed. Furthermore, SEM observation indicated that the fibers had an open C-form cross-sectional shape in which the major-axis width of the fiber cross section was 69 μm and the minor-axis width was 29 μm (flattening ratio: 2.4). The external appearance of the fibers showed little feeling of the presence of the individual fibers.

COMPARATIVE EXAMPLE 7

A uniformly mixed and dissolved acetone solution containing 29.5 wt % acrylic type copolymer consisting of 49 wt % acrylonitrile, 50 wt % vinyl chloride and 1 wt % sodium styrenesulfonate, and 0.59 wt % cellulose acetate with a degree of acetification of 56%, was used as a spinning stock solution. This spinning stock solution was discharged into a solidifying bath consisting of a 25 wt % aqueous solution of acetone at 35° C. via a spinning nozzle with 400 rectangular slit-form holes having dimensions of 0.08 mm×0.6 mm. The spun fibers were taken up by a roller at a take-up rate of 2 m/min; next, drawing to a draw ratio of 1.4 times was applied in a 55 wt % aqueous solution of acetone at 25° C., and drawing to a draw ratio of 1.36 times was further applied in a 25 wt % aqueous solution of acetone at 25° C. Afterward, the fibers were rinsed with water via a water rinse bath at 40° C. and a water rinse bath at 75° C., and the fibers were then rinsed again while being drawn to a draw ratio of 1.5 times in a water rinse bath at 75° C. The fibers were then oiled. Next, after being dried in a uniform-heat air draft drier at 130° C., the fibers were further drawn to a draw ratio of 2 at the same temperature, and were then subjected to a heat treatment at 145° C., thus producing fibers with a denier of 17.3 dtex. Appropriate oiling agent application and mechanical crimping were performed on these fibers using universally known methods, and the fibers were further cut to 51 mm; afterward, the fibers were dyed in the same manner as in Example 8. As a result, the dyed fabric material consisting of these fibers showed an L value of 39.4, and the rate of drop in the specific gravity caused by dyeing was 0%, so that no porosification was observed. Furthermore, SEM observation indicated that the fibers had a more or less rectangular cross-sectional shape in which the major-axis width of the fiber cross section was 107 μm and the minor-axis width was 21 μm (flattening ratio: 5.1). The external appearance of the fibers showed little feeling of the presence of the individual fibers.

EXAMPLE 9

An acetone solution containing 27 wt % acrylic type copolymer consisting of 52 wt % acrylonitrile, 47 wt % vinylidene chloride and 1 wt % sodium styrenesulfonate, 2.7 wt % PVAc and 0.27 wt % cellulose acetate with a degree of acetification of 54% was uniformly mixed and dissolved to form a spinning stock solution. This spinning stock solution was discharged into a solidifying bath consisting of a 25 wt % aqueous solution of acetone at 35° C. via a spinning nozzle with 150 rectangular slit-form holes having dimensions of 0.05 mm×0.43 mm. The spun fibers were taken up by a roller at a take-up rate of 2.5 m/min; next, drawing to a draw ratio of 1.4 times was applied in a 55 wt % aqueous solution of acetone at 25° C., and drawing to a draw ratio of 1.36 times was further applied in a 25 wt % aqueous solution of acetone at 25° C. Afterward, the fibers were rinsed with water via a water rinse bath at 40° C. and a water rinse bath at 75° C., and the fibers were then rinsed again while being drawn to a draw ratio of 1.58 times in a water rinse bath at 75° C. The fibers were then oiled. Next, after being dried in a uniform-heat air draft drier at 130° C., the fibers were further drawn to a draw ratio of 2.25 at the same temperature, and were then subjected to a heat treatment at 145° C., thus producing fibers with a denier of 11.6 dtex in which the major-axis width of the fiber cross section (as seen from SEM observation) was 83 μm. Appropriate oiling agent application and mechanical crimping were performed on these fibers using universally known methods, and the fibers were further cut to 51 mm; afterward, the fibers were dyed in the same manner as in Example 8. As a result, the dyed fabric material consisting of these fibers was a dyed fabric material with a superior external appearance, in which the L value was 48.7 and the rate of the drop in specific gravity caused by dyeing was 4.3%; moreover, SEM observation showed this fabric material to have a more or less rectangular cross section in which the major-axis width of the fiber cross section was 85 μm and the minor-axis width was 22 μm (flattening ratio: 3.9), and the feeling of the presence of individual fibers was conspicuous.

COMPARATIVE EXAMPLE 8

Fibers were manufactured in exactly the same manner as in Example 9 except that the PVAc and cellulose acetate added to the spinning stock solution in Example 9 were not added. As a result, fibers with a denier of 11.8 dtex were obtained. When these fibers were dyed in the same manner as in Example 8, the dyed fabric material consisting of these fibers showed an L value of 35.7, and the rate of drop in the specific gravity caused by dyeing was 0.8%, so that almost no porosification was observed. Furthermore, SEM observation indicated that the fibers had a more or less rectangular cross-sectional shape in which the major-axis width of the fiber cross section was 120 μm and the minor-axis width was 15 μm (flattening ratio: 8.0). The external appearance of the fibers showed little feeling of the presence of the individual fibers.

EXAMPLE 10

An acrylic type copolymer consisting of 49 wt, % acrylonitrile, 50 wt % vinyl chloride and 1 wt % sodium styrenesulfonate was dissolved in acetone at the rate of 30 wt %. An acetone solution in which PVAc was dissolved at a concentration of 40 wt % was added to the abovementioned acetone solution so that the PVAc content of the resulting solution was 1 part by weight per 100 parts by weight of the abovementioned acrylic type copolymer; furthermore, an acetone solution in which cellulose acetate with a degree of acetification of 55% was dissolved at the rate of 15 wt % was added to the abovementioned solution so that the cellulose acetate content of the resulting solution was 10 parts by weight per 100 parts by weight of the abovementioned acrylic type copolymer, and the solution obtained by mixing and agitating these ingredients was used as a spinning stock solution. This spinning stock solution was discharged into a solidifying bath consisting of a 25 wt % aqueous solution of acetone at 35° C. via a spinning nozzle with 50 rectangular slit-form holes having dimensions of 0.1 mm×0.85 mm, and the spun fibers were taken up by a roller at a take-up rate of 4 m/min. Next, drawing to a draw ratio of 1.5 times was applied in a 55 wt % aqueous solution of acetone at 25° C., and drawing to a draw ratio of 1.02 times was further applied in a 25 wt % aqueous solution of acetone at 25° C. Afterward, the fibers were rinsed with water via a water rinse bath at 40° C. and a water rinse bath at 75° C., and the fibers were then rinsed again while being drawn to a draw ratio of 1.25 times in a water rinse bath at 75° C. The fibers were then oiled. Next, after being dried in a uniform-heat air draft drier at 130° C., the fibers were further drawn to a draw ratio of 1.5 at the same temperature, and were then subjected to a heat treatment at 145° C. The fibers thus obtained had a denier of 44.8 dtex; furthermore, according to SEM observation, the major-axis width of the fiber cross section was 185 μm, and the fibers had a superior external appearance with an extremely strong feeling of the presence of the individual fibers. Appropriate oiling agent application and mechanical crimping were performed on these fibers using universally known methods, and the fibers were further cut to 51 mm; afterward, the fibers were dyed in the same manner as in Example 8. As a result, the dyed fabric material consisting of these fibers was a dyed fabric material with a superior external appearance, in which the L value was 43.8 and the rate of the drop in specific gravity caused by dyeing was 8.0%; moreover, SEM observation showed this fabric material to have a more or less rectangular cross section in which the major-axis width of the fiber cross section was 190 μm and the minor-axis width was 35 μm (flattening ratio: 5.4), and the feeling of the presence of individual fibers was conspicuous.

Characteristic values and external appearance evaluation results for the fibers obtained in the abovementioned Examples 8 through 10 and Comparative Examples 5 through 8 are shown in Table 3.

TABLE 3

| | Acrylic type copolymer composition | Solvent | Amount of polyvinyl acetate added (parts by weight) | Cellulose acetate (parts by weight) | Porosification treatment method | Treatment time (minutes) |
|---|---|---|---|---|---|---|
| Example 8 | AN/VCL | Acetone | 5 | 2 | 98° C. dyeing | 60 |
| Example 9 | AN/VD | Acetone | 10 | 1 | 98° C. dyeing | 60 |
| Example 10 | AN/VCL | Acetone | 1 | 10 | 98° C. dyeing | 60 |
| Comparative Example 5 | AN/VCL | Acetone | 0 | 0 | 98° C. dyeing | 60 |
| Comparative Example 6 | AN/VCL | Acetone | 0 | 0 | 98° C. dyeing | 60 |
| Comparative Example 7 | AN/VCL | Acetone | 0 | 2 | 98° C. dyeing | 60 |
| Comparative Example 8 | AN/VD | DMAc | 0 | 0 | 98° C. dyeing | 60 |

| | Fiber cross-sectional length | | | True specific | Specific | Rate of drop in specific | Rate of drop in specific | | External |
|---|---|---|---|---|---|---|---|---|---|
| | Major-axis length (μm) | Minor-axis length (μm) | Flattening ratio | gravity of acrylic type copolymer ($g/cm^3$) | gravity of porosified fibers ($g/cm^3$) | gravity from true specific gravity (%) | gravity caused by porosification (%) | L value | appearance of porous acrylic fibers |
| Example 8 | 113 | 18 | 6.3 | 1.28 | 1.20 | 6.3 | 6.2 | 49.8 | ○ |
| Example 9 | 85 | 22 | 3.9 | 1.34 | 1.24 | 7.5 | 4.3 | 48.7 | ○ |
| Example 10 | 190 | 35 | 5.4 | 1.28 | 1.18 | 7.8 | 8.0 | 43.8 | ◎ |
| Comparative Example 5 | 116 | 18 | 6.4 | 1.28 | 1.28 | 0 | 0.5 | 38.3 | X |
| Comparative Example 6 | 69 | 29 | 2.4 | 1.28 | 1.28 | 0 | 0 | 33.7 | X |
| Comparative Example 7 | 107 | 21 | 5.1 | 1.28 | 1.27 | 0.8 | 0 | 39.4 | X |
| Comparative Example 8 | 120 | 15 | 8.0 | 1.35 | 1.35 | 0 | 0.8 | 35.7 | X |

Note)
In the polymer compositions shown in the table, AN indicates acrylonitrile, VCL indicates vinyl chloride, VD indicates vinylidene chloride, and VAc indicates vinyl acetate.

EXAMPLES 11~15

Five types of pile fabrics (Examples 11 through 15) were prepared by mixing 70 parts by weight of each of the fabrics obtained in Examples 1 through 5 with 30 parts by weight of the commercially marketed acrylic fibers "Kanekalon (registered trademark) SL" (3.3 dtex, 32 mm; manufactured by Kanegafuchi Kagaku Kogyo K.K.). The final weight of the pile fabrics in this case was 950 $g/m^2$, and the mean pile length was 20 mm. As is shown in Table 4, the pile fabrics thus obtained showed superior external appearance characteristics in which the presence of the individual fibers of the pile part was emphasized to a considerable extent.

COMPARATIVE EXAMPLES 9~12

Four types of pile fabrics (Comparative Examples 9 through 12) were prepared by mixing 70 parts by weight of each of the fibers obtained in Comparative Examples 1 through 4 with the commercially marketed acrylic fibers "Kanekalon (registered trademark) SL" (3.3 dtex, 32 mm; manufactured by Kanegafuchi Kagaku Kogyo K.K.). The final weight of the pile fabrics in this case was 950 $g/m^2$, and the mean pile length was 20 mm. In the pile fabrics thus obtained, as is shown in Table 4, the feeling of the presence of the individual fibers in the pile part was fairly poor.

TABLE 4

| | Proportions of fibers used (parts by weight) | Construction of pile | Mean pile length (mm) | Weight of pile fabric (g/cm$^2$) | External appearance of pile fabric |
|---|---|---|---|---|---|
| Example 11 | Example 1/SL = 70/30 | Plain construction with uniform pile length | 20 | 950 | ○ |
| Example 12 | Example 2/SL = 70/30 | Plain construction with uniform pile length | 20 | 950 | ○ |
| Example 13 | Example 3/SL = 70/30 | Plain construction with uniform pile length | 20 | 950 | ○ |
| Example 14 | Example 4/SL = 70/30 | Plain construction with uniform pile length | 20 | 950 | ○ |
| Example 15 | Example 5/SL = 70/30 | Plain construction with uniform pile length | 20 | 950 | ○ |
| Comparative Example 9 | Comparative Example 1/SL = 70/30 | Plain construction with uniform pile length | 20 | 950 | X |
| Comparative Example 10 | Comparative Example 2/SL = 70/30 | Plain construction with uniform pile length | 20 | 950 | X |
| Comparative Example 11 | Comparative Example 3/SL = 70/30 | Plain construction with uniform pile length | 20 | 950 | X |
| Comparative Example 12 | Comparative Example 4/SL = 70/30 | Plain construction with uniform pile length | 20 | 950 | X |

EXAMPLES 16 and 17

COMPARATIVE EXAMPLE 13

Pile fabrics were prepared by mixing 30 parts by weight of the acrylic fiber obtained in Example 1, 50 parts by weight of the commercially marketed acrylic fiber "Kanekalon (registered trademark) RLM (BR517)" (12 dtex, 44 mm; manufactured by Kanegafuchi Kagaku Kogyo K.K.) and 20 parts by weight of the commercially marketed acrylic fiber "Kanekalon (registered trademark) AHD (10)" (4.4 dtex, 32 mm; manufactured by Kanegafuchi Kagaku Kogyo K.K.) (Example 16), mixing 10 parts by weight of the acrylic fiber obtained in Example 1, 70 parts by weight of the abovementioned acrylic fiber "Kanekalon (registered trademark) RLM (BR517)" and 20 parts by weight of the abovementioned acrylic fiber "Kanekalon (registered trademark) AHD (10)" (Example 17), and mixing 2 parts by weight of the acrylic fiber obtained in Example 1, 78 parts by weight of the abovementioned acrylic fiber "Kanekalon (registered trademark) RLM (BR517)" and 20 parts by weight of the abovementioned acrylic fiber "Kanekalon (registered trademark) AHD (10)" (Comparative Example 13). The final weight of the pile fabrics in this case was 950 g/m$^2$, the mean pile length was 20 mm, and the step difference was 6 mm. As is shown in Table 5, the pile fabrics obtained in Examples 16 and 17 showed superior external appearance characteristics in which a feeling of the presence of the individual fibers of the pile part was emphasized to a considerable extent; however, in the case of Comparative Example 13, the feeling of the presence of the individual fibers of the pile part was fairly poor.

TABLE 5

| | Proportions of fibers used (parts by weight) | Proportions of construction of overall pile part, long pile/short pile (wt %) | Proportion of fibers of Example 1 in long pile part (wt %) | Mean pile length of long pile part (mm) | Step difference* (mm) | Weight of pile fabric (g/cm$^2$) | External appearance of pile fabric |
|---|---|---|---|---|---|---|---|
| Example 16 | Example 1/RLM/AHD = 30/50/20 | 80/20 | 37.5 | 20 | 6 | 950 | ○ |
| Example 17 | Example 1/RLM/AHD = 10/70/20 | 80/20 | 12.5 | 20 | 6 | 950 | ○ |

TABLE 5-continued

| | Proportions of fibers used (parts by weight) | Proportions of construction of overall pile part, long pile/short pile (wt %) | Proportion of fibers of Example 1 in long pile part (wt %) | Mean pile length of long pile part (mm) | Step difference* (mm) | Weight of pile fabric (g/cm$^2$) | External appearance of pile fabric |
|---|---|---|---|---|---|---|---|
| Comparative Example 13 | Example 1/RLM/AHD = 2/78/20 | 80/20 | 2.5 | 20 | 6 | 950 | X |

*Step difference: difference in mean pile length between long pile and short pile

EXAMPLES 18~20

COMPARATIVE EXAMPLE 14

Pile fabrics were prepared by mixing 10 parts by weight of the acrylic fabric obtained in Example 6 and 90 parts by weight of the commercially marketed acrylic fiber "Kanekalon (registered trademark) AHD (10)" (4.4 dtex, 32 mm; manufactured by Kanegafuchi Kagaku Kogyo K.K.) (Example 18), and by mixing 2 parts by weight of the acrylic fiber obtained in Example 6 and 98 parts by weight of the abovementioned acrylic fiber "Kanekalon (registered trademark) AHD (10)" (Comparative Example 14). The final weight of the pile fabrics in this case was 880 g/m$^2$, the mean pile length was 15 mm, and the step difference was 4 mm. Similarly, pile fabrics were prepared by mixing 30 parts by weight of the acrylic fiber obtained in Example 7 and 70 parts by weight of the commercially marketed acrylic fiber "Kanekalon (registered trademark) AH (740)" (5.6 dtex, 38 mm; manufactured by Kanegafuchi Kagaku Kogyo K.K.) (Example 19), and by mixing 10 parts by weight of the acrylic fiber obtained in Example 7, 20 parts by weight of the commercially marketed acrylic fiber "Kanekalon (registered trademark) RCL" (17 dtex, 51 mm; manufactured by Kanegafuchi Kagaku Kogyo K.K.), and 70 parts by weight of the abovementioned acrylic fiber "Kanekalon (registered trademark) AH (740)" (Example 20). The final weight of the pile fabrics in this case was 900 g/m$^2$ in all of the fabrics, the mean pile length was 47 mm, and the step difference was 25 mm. As is shown in Table 6, the pile fabrics obtained in Examples 18 through 20 showed superior external appearance characteristics in which a feeling of the presence of the individual fibers of the pile part was emphasized to a considerable extent; however, in the case of Comparative Example 14, the feeling of the presence of the individual fibers of the pile part was fairly poor.

Industrial Applicability

The porous acrylic fiber is porosified in an after-process following spinning, crimping and cutting, so that a feeling of the presence of the individual fibers is emphasized. Furthermore, a porous structure can easily be obtained by performing a hydrothermal treatment or saturated steam treatment such as a dyeing operation or the like following spinning, crimping and cutting. Accordingly, for fiber makers, the present invention has the merit of not requiring the addition of special conditions or apparatus to the manufacturing process accompanying porosification. Furthermore, the pile fabric of the present invention consisting of the abovementioned porous acrylic fiber has extremely superior external appearance characteristics in which a feeling of the presence of the individual fibers forming the pile part appears to be emphasized. As a result, a novel product design which is superior in design characteristics for clothing, toys (stuffed animals) and interior use or the like can be obtained.

What is claimed is:

1. A porous acrylic fiber that is mainly composed of a resin composition containing 0.3 to 20 parts by weight of polyvinyl acetate based on 100 parts by weight of an acrylic type copolymer, said fiber being characterized in that a denier of the fiber is 2 to 50 dtex, a flattening ratio of the fiber cross section (ratio of a major-axis width to a minor-axis width) is 2.5 to 25, the major-axis width is 70 to 300 $\mu$m, and the rate of the drop in specific gravity thereof is in the range of 5.0 to 20% when calculated by the Equation $$\text{Rate of drop in specific gravity } (\%) = 100 \times (1 - Da/Db)$$

where, Da indicates the specific gravity value of the porous acrylic fiber, and Db indicates the true specific gravity value of the resin consisting of the acrylic type copolymer.

2. The porous acrylic fiber according to claim 1, wherein said acrylic type copolymer is a copolymer consisting essen-

TABLE 6

| | Proportions of fibers used (parts by weight) | Proportions of construction of overall pile part, long pile/short pile (wt %) | Proportion of fibers of Example 1 in long pile part (wt %) | Mean pile length of long pile part (mm) | Step difference* (mm) | Weight of pile fabric (g/cm$^2$) | External appearance of pile fabric |
|---|---|---|---|---|---|---|---|
| Example 18 | Example 6/AHD = 10/90 | 10/90 | 100 | 15 | 4 | 880 | ○ |
| Comparative Example 14 | Example 6/AHD = 2/98 | 2/98 | 100 | 15 | 4 | 880 | Δ |
| Example 19 | Example 7/AH = 30/70 | 30/70 | 100 | 47 | 25 | 900 | ○ |
| Example 20 | Example 7/RCL/AH = 10/20/70 | 30/70 | 33.3 | 47 | 25 | 900 | ○ |

*Step difference: difference in mean pile length between long pile and short pile tially of 35 to 98 wt % acrylonitrile and 2 to 65 wt % other vinyl type monomer(s) copolymerizable with acrylonitrile.

3. The porous acrylic fiber according to claim 1, wherein said acrylic type copolymer is a copolymer consisting essentially of 35 to 98 wt % acrylonitrile, 2 to 65 wt % vinyl chloride and/or vinylidene chloride, and 0 to 10 wt % sulfonate-group-containing vinyl type monomer(s) copolymerizable with these compounds.

4. The porous acrylic fiber according to claim 1, wherein said resin composition contains 0.3 to 20 parts by weight of polyvinyl acetate and 0.5 to 15parts by weight of cellulose resin based on 100 parts by weight of acrylic type copolymer.

5. The porous acrylic fiber according to claim 4, wherein said cellulose resin consists of at least one resin selected from a group consisting of cellulose acetate, cellulose propionate and cellulose acetate butyrate.

6. A method for producing the porous acrylic fiber according to claim 1, characterized in that fibers formed by wet-spinning a spinning stock solution containing 0.3 to 20 parts by weight of polyvinyl acetate based on 100 parts by weight of an acrylic type copolymer so that a denier of the fiber is 2 to 50 dtex, a flattening ratio of the fiber cross section (ratio of a major-axis width to a minor-axis width) is 2.5 to 25, and the major-axis width is 70 to 300 $\mu$m, are subjected to crimping and cutting treatments, and are then porosified by a hydrothermal treatment for 30 to 120 minutes at 90 to 100° C. and/or a saturated steam treatment for 10 to 90 minutes at 90to 130° C.

7. A method for producing the porous acrylic fiber according to claim 4, characterized in that fibers formed by wet-spinning a spinning stock solution containing 0.3 to 20 parts by weight of polyvinyl acetate and 0.5 to 15 parts by weight of a cellulose resin based on 100 parts by weight of an acrylic type copolymer so that a denier of the fiber is 2 to 50 dtex, a flattening ratio of the fiber cross section (ratio of a major-axis width to a minor-axis width) is 2.5 to 25, and the major-axis width is 70 to 300 $\mu$m, are subjected to crimping and cutting treatments, and are then porosified by a hydrothermal treatment for 30 to 120 minutes at 90 to 100° C. and/or a saturated steam treatment for 10 to 90 minutes at 90 to 130° C.

8. The method for producing a porous acrylic fiber according to claim 6 or claim 7, wherein the hydrothermal treatment is a dyeing operation.

9. The porous acrylic fiber produced by the method according to claims 6 or 7, wherein the rate of the drop in specific gravity is in the range of 3.0 to 15% when calculated from the specific gravity (Dp) before porosification and the specific gravity (Da) of the porosified fiber by the Equation $$\text{Rate of drop in specific gravity } (\%) = 100 \times (1 - Da/Dp).$$

10. A pile fabric comprising the porous acrylic fiber according to any one of claims 1 through 5, 6 and 7.

11. The pile fabric according to claim 10, which contains said porous acrylic fiber at the rate of 3 wt % or greater in the pile part.

12. The pile fabric according to claim 10, which is a pile fabric having a step difference that has at least a long pile part and a short pile part, wherein said porous acrylic fiber is contained in the long pile part.

13. The pile fabric according to claim 12, wherein said porous acrylic fiber is contained in the fibers of the overall pile part at the rate of 5 to 60 wt %.

14. The pile fabric according to claim 12, wherein the difference between the mean pole length of the long pile part and the mean pile length of the short pile part in said pile fabric having a step difference is 2 mm or greater, and the mean pile length of the long pile part is 12 to 70 mm.

* * * * *